US009371609B2

(12) United States Patent
Anderson et al.

(10) Patent No.: US 9,371,609 B2
(45) Date of Patent: Jun. 21, 2016

(54) DRYER APPLIANCES AND METHODS FOR OPERATING SAME

(71) Applicant: General Electric Company, Schenectady, NY (US)

(72) Inventors: Timothy Lee Anderson, Louisville, KY (US); Alisa Marie Dickerson, Louisville, KY (US); Lois Haeun Kwon, Louisville, KY (US)

(73) Assignee: General Electric Company, Schenectady, NY (US)

( * ) Notice: Subject to any disclaimer, the term of this patent is extended or adjusted under 35 U.S.C. 154(b) by 150 days.

(21) Appl. No.: 14/313,036

(22) Filed: Jun. 24, 2014

(65) Prior Publication Data

US 2015/0368854 A1 Dec. 24, 2015

(51) Int. Cl.

*D06F 58/20* (2006.01)
*D06F 58/28* (2006.01)
*D06F 58/04* (2006.01)

(52) U.S. Cl.

CPC ..... *D06F 58/28* (2013.01); *D06F 58/04* (2013.01); *D06F 2058/2816* (2013.01); *D06F 2058/2819* (2013.01); *D06F 2058/2864* (2013.01)

(58) Field of Classification Search

CPC ..... F26B 5/00; F26B 11/00; F26B 19/00; F26B 21/00; D06F 58/00; D06F 58/20; D06F 58/23

USPC ..... 34/413, 595, 601, 610; 68/5 C, 5 R, 19, 68/20; 8/139, 149, 159

See application file for complete search history.

(56) References Cited

U.S. PATENT DOCUMENTS 2,038,431 A * 4/1936 Klages ..... D06B 1/00 34/110
3,045,993 A * 7/1962 Sidaris ..... D06F 58/263 200/19.36
3,216,126 A * 11/1965 Brucken ..... D06F 58/28 34/527
5,050,313 A * 9/1991 Wakaeya ..... F26B 21/06 34/454
5,347,727 A 9/1994 Kim
5,396,715 A * 3/1995 Smith ..... D06F 58/266 219/710
5,651,192 A * 7/1997 Horwitz ..... D06F 58/28 219/494
5,755,041 A * 5/1998 Horwitz ..... D06F 58/28 34/491
6,079,121 A 6/2000 Khadkikar et al.
6,092,301 A * 7/2000 Komanowsky ..... F26B 5/048 34/263
6,098,310 A 8/2000 Chen et al.
6,122,840 A 9/2000 Chbat et al.
6,141,887 A 11/2000 Chen et al.
7,020,985 B2 * 4/2006 Casey ..... D06F 58/206 34/595
7,073,273 B2 * 7/2006 Kim ..... D06F 58/20 34/595
7,093,374 B2 8/2006 Yang et al.
7,765,715 B2 8/2010 Kim (Continued)

FOREIGN PATENT DOCUMENTS

BE EP 2458075 A1 * 5/2012 ..... D06F 58/28
CN 2195564 4/1995

(Continued)

*Primary Examiner* — Stephen M Gravini
(74) *Attorney, Agent, or Firm* — Dority & Manning, P.A.

(57) ABSTRACT

Dryer appliances and methods for operating dryer appliances are provided. A method includes flowing internal air from a drum chamber through a vent duct of the dryer appliance, selectively actuating a valve to flow external air through the vent duct from external to a cabinet of the dryer appliance, and alternately sensing humidity values of the internal air and the external air.

20 Claims, 8 Drawing Sheets

(56) References Cited

U.S. PATENT DOCUMENTS

| | | | | |
|---|---|---|---|---|
| 8,104,191 | B2 * | 1/2012 | Ricklefs | D06F 58/203 34/474 |
| 8,627,581 | B2 * | 1/2014 | Brown | D06F 58/02 34/603 |
| 9,080,280 | B2 * | 7/2015 | Koops | D06F 58/02 |
| 2005/0044743 | A1 | 3/2005 | Park | |
| 2008/0072448 | A1 | 3/2008 | Hubig et al. | |
| 2011/0047812 | A1 | 3/2011 | Sugimoto et al. | |
| 2011/0203131 | A1 | 8/2011 | Armstrong | |
| 2012/0124859 | A1 | 5/2012 | May et al. | |
| 2013/0091728 | A1 | 4/2013 | Morin et al. | |
| 2014/0041249 | A1 * | 2/2014 | Jung | D06F 58/206 34/282 |
| 2014/0245630 | A1 * | 9/2014 | McCarthy | D06F 58/04 34/487 |
| 2015/0322618 | A1 * | 11/2015 | Bisaro | D06F 58/28 62/79 |
| 2015/0368854 | A1 * | 12/2015 | Anderson | D06F 58/28 34/491 |

FOREIGN PATENT DOCUMENTS

| | | | | |
|---|---|---|---|---|
| CN | 200964526 | | 10/2007 | |
| CN | 201793970 | | 4/2011 | |
| CN | 201883318 | | 6/2011 | |
| CN | 202148441 | | 2/2012 | |
| CN | 102031684 | | 6/2012 | |
| EP | 0388939 | | 8/1993 | |
| EP | 0926292 | | 6/1999 | |
| EP | 1612319 | | 1/2006 | |
| EP | 1790769 | | 4/2010 | |
| EP | 2436833 | | 4/2012 | |
| EP | 2516719 | | 11/2013 | |
| JP | H05-115688 | | 5/1993 | |
| JP | H06-296798 | | 10/1994 | |
| JP | H07-265597 | | 10/1995 | |
| JP | H08-252395 | | 10/1996 | |
| JP | H10-141851 | | 5/1998 | |
| JP | 2002282595 | | 10/2002 | |
| JP | 2008104625 | | 5/2005 | |
| JP | 2012196394 | | 10/2012 | |
| KR | 2005042540 | | 5/2005 | |
| KR | 10-0550800 | | 2/2006 | |
| KR | WO 2006019201 | A1 * | 2/2006 | D06F 25/00 |
| KR | DE 102006014871 | A1 * | 10/2006 | D06F 58/04 |
| KR | 2007044238 | | 4/2007 | |
| KR | 10-0755390 | | 9/2007 | |
| KR | 10-2011-0082247 | | 7/2011 | |
| NL | WO 2010151128 | A2 * | 12/2010 | D06F 58/02 |
| NL | WO 2010151128 | A3 * | 5/2011 | D06F 58/02 |
| TW | 1265991 | | 11/2006 | |
| WO | WO 02/057533 | | 7/2002 | |

* cited by examiner

DRYER APPLIANCES AND METHODS FOR OPERATING SAME

FIELD OF THE INVENTION

The present subject matter relates generally to dryer appliances and associated methods, and more particularly to the use of differential humidity sensing to determine appropriate dry times.

BACKGROUND OF THE INVENTION

Dryer appliances generally include a cabinet with a drum mounted therein. In many dryer appliances, a motor rotates the drum during operation of the dryer appliance, e.g., to tumble articles located within a chamber defined by the drum. Alternatively, dryer appliances with fixed drums have been utilized. Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance.

In many dryer appliances, dry cycles operate for predetermined periods of time. A user may, for example, choose various variables, such as dryness level and load size, and a set time period for a dry cycle may be set based on these variables. These predetermined dry cycle time periods, however, can result in over-drying or under-drying of articles being dried, because other variables such as the moisture content of the articles is not taken into account. More recently, attempts have been made to determine appropriate dry cycle time periods for articles in real time during dry cycles, in order to reduce instances of over-drying and under-drying. For example, attempts have been made to measure the resistance across the articles during the dry cycle and correlate these measurements to dryness. Alternatively, humidity sensors have been utilized to measure the humidity of the internal air in the dryer appliance. Such attempts, however, can be complex and unreliable, and may for example still result in instances of over-drying and under-drying.

Accordingly, improved dryer appliances and methods for operating dryer appliances are desired in the art. In particular, dryer appliances and associated methods which facilitate reduced or eliminated instances of over-drying and under-drying would be advantageous.

BRIEF DESCRIPTION OF THE INVENTION

In one embodiment, a dryer appliance is disclosed. The dryer appliance includes a cabinet defining an interior, and a drum positioned within the interior, the drum defining a chamber for receipt of articles for drying. The dryer appliance further includes an outlet assembly positioned within the interior, the outlet assembly including a vent duct and an exhaust conduit in fluid communication with the vent duct, wherein internal air flows from the chamber through the vent duct to the exhaust conduit. The dryer appliance further includes a valve selectively operable to flow external air to the vent duct from external to the cabinet, and a humidity sensor positioned within the vent duct. Selective operation of the valve causes the humidity sensor to alternately sense internal air humidity values and external air humidity values.

In another embodiment, a method for operating a dryer appliance is disclosed. The method includes flowing internal air from a drum chamber through a vent duct of the dryer appliance, selectively actuating a valve to flow external air through the vent duct from external to a cabinet of the dryer appliance, and alternately sensing humidity values of the internal air and the external air.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
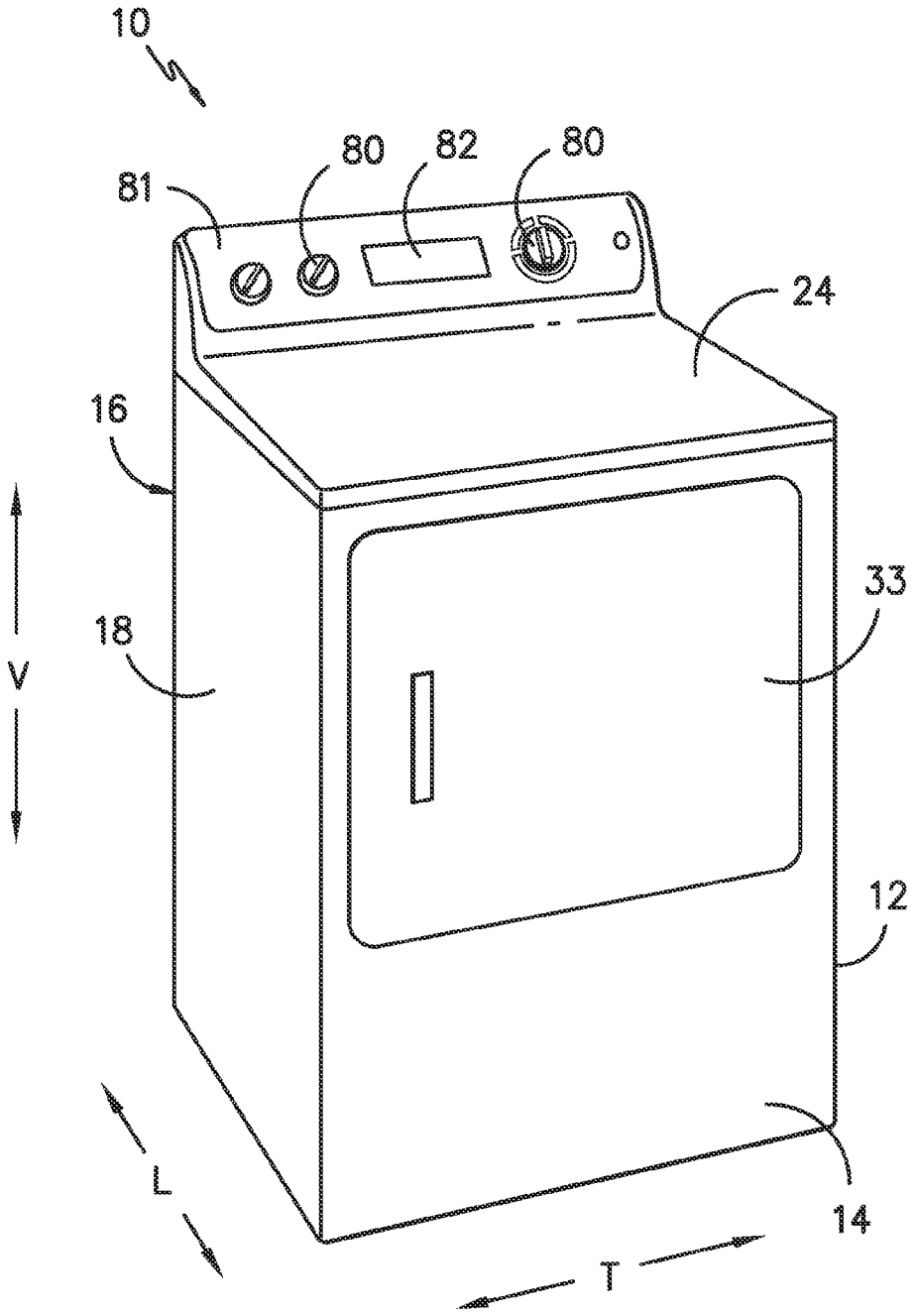
FIG. 1 provides a perspective view of a dryer appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
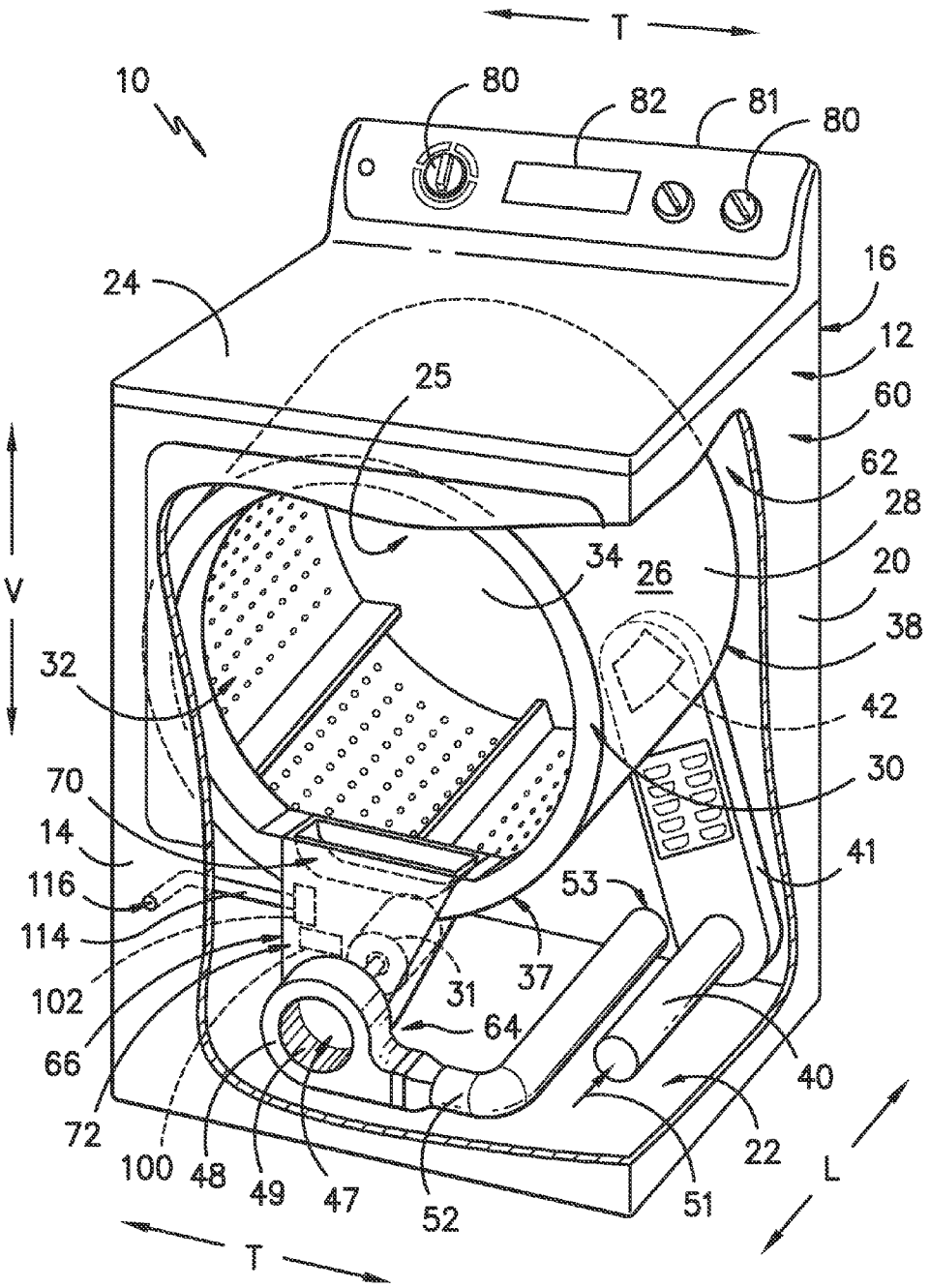
FIG. 2 provides a perspective view of the dryer appliance of FIG. 1 with portions of a cabinet of the dryer appliance removed to reveal certain components of the dryer appliance.
Figure 3:
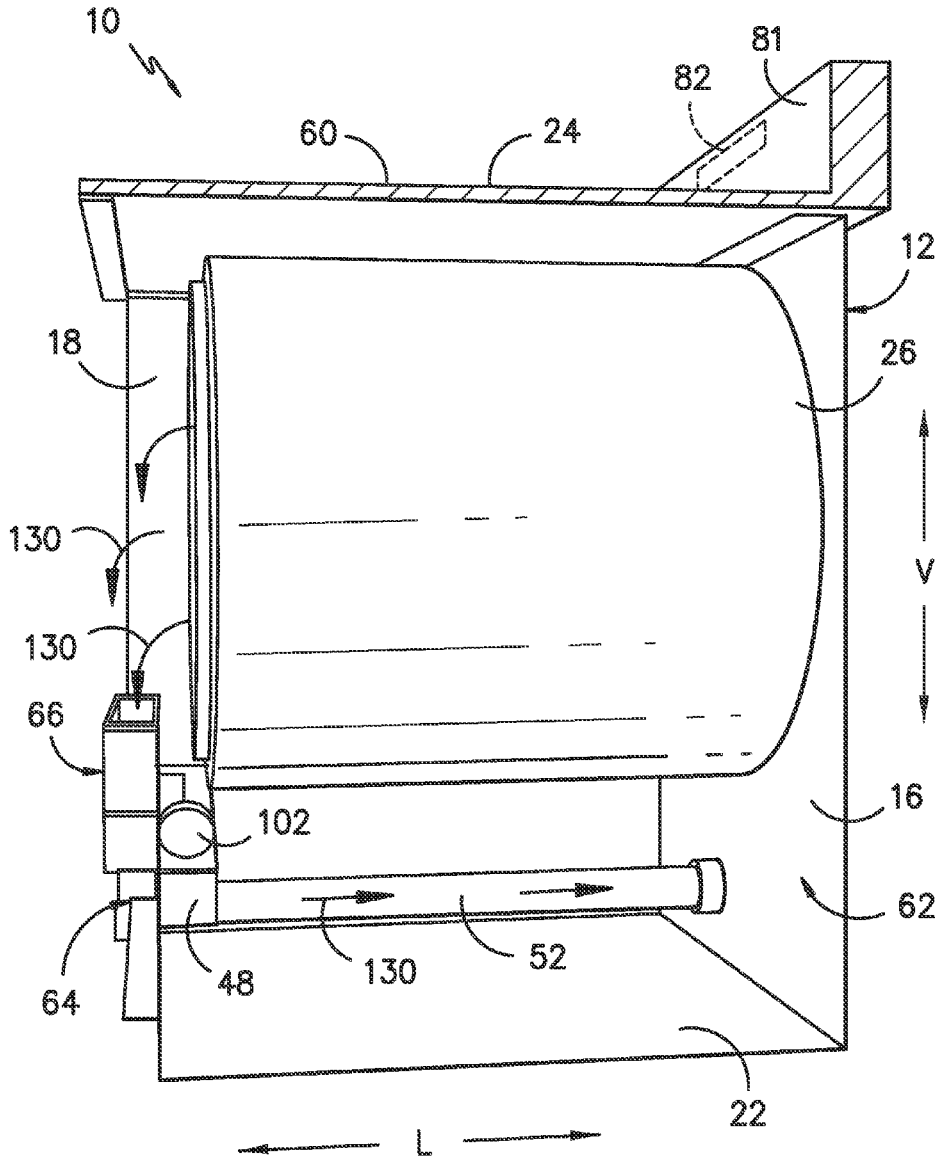
FIG. 3 provides a side schematic view of various components of a dryer appliance in accordance with one embodiment of the present disclosure.
Figure 4:
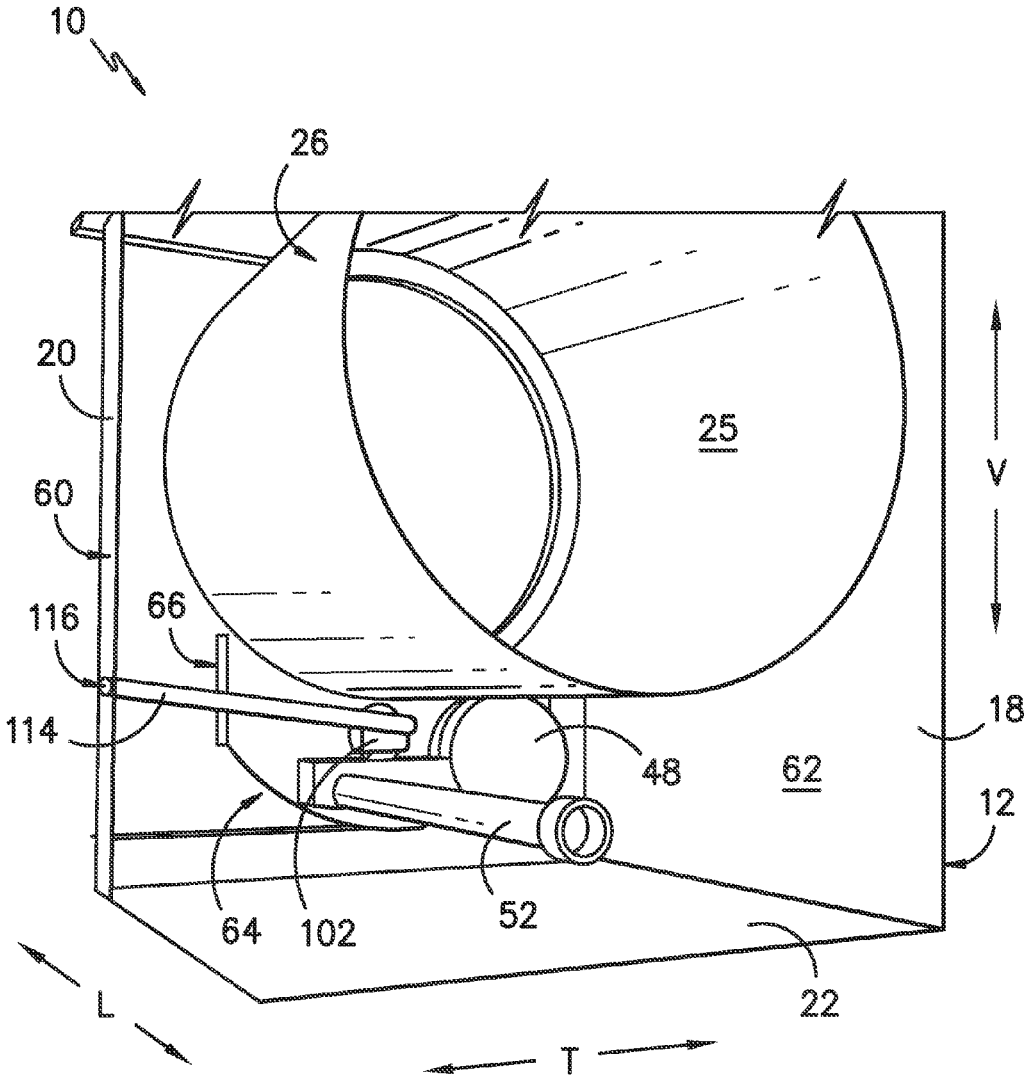
FIG. 4 is a rear perspective view of various components of a dryer appliance in accordance with one embodiment of the present disclosure.
Figure 5:
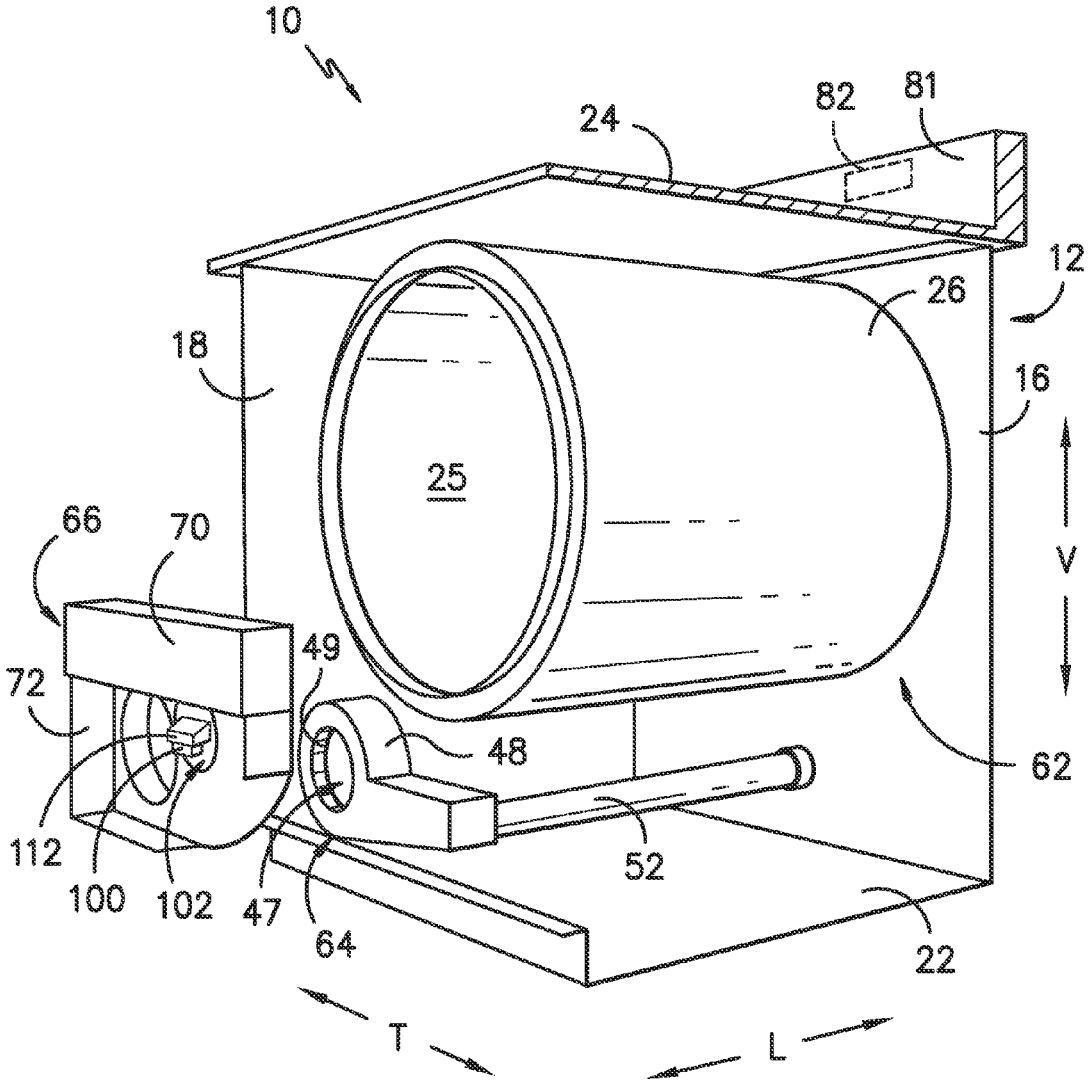
FIG. 5 is a front perspective view of various components of a dryer appliance in accordance with one embodiment of the present disclosure.

FIG. 1 illustrates a dryer appliance 10 according to an exemplary embodiment of the present subject matter. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. Dryer appliance 10 defines a vertical direction V, a lateral direction L, and a transverse direction T. The vertical direction V, lateral direction L, and transverse direction T are mutually perpendicular and form and orthogonal direction system.

Cabinet 12 includes a front panel 14, a rear panel 16, a pair of side panels 18 and 20 spaced apart from each other by front and rear panels 14 and 16, a bottom panel 22, and a top cover 24. These panels and cover collectively define an external surface 60 of the cabinet 12 and an interior 62 of the cabinet. Within interior 62 of cabinet 12 is a drum or container 26. Drum 26 defines a chamber 25 for receipt of articles, e.g., clothing, linen, etc., for drying. Drum 26 extends between a front portion 37 and a back portion 38, e.g., along the lateral direction L. In exemplary embodiments the drum 26 is rotational. Alternatively, however, the drum 26 may be fixedly mounted within the interior 62.

Drum 26 is generally cylindrical in shape, having an outer cylindrical wall or cylinder 28 and a front flange or wall 30 that may define an entry 32 of drum 26, e.g., at front portion 37 of drum 26, for loading and unloading of articles into and out of chamber 25 of drum 26. Drum 26 also includes a back or rear wall 34, e.g., at back portion 38 of drum 26. In alternative embodiments, entry 32 may be defined in top cover 24 and cylinder 28, and front wall 30 may be a generally solid wall.

A motor 31 may be in mechanical communication with an air handler 48 such that motor 31 rotates a fan 49, e.g., a centrifugal fan, of air handler 48. Air handler 48 is configured for drawing air through chamber 25 of drum 26, e.g., in order to dry articles located therein as discussed in greater detail below. In alternative exemplary embodiments, dryer appliance 10 may include an additional motor (not shown) for rotating fan 49 of air handler 48 independently of drum 26.

Drum 26 may be configured to receive heated air that has been heated by a heating assembly 40, e.g., in order to dry damp articles disposed within chamber 25 of drum 26. Heating assembly 40 includes a heating element (not shown), such as a gas burner or an electrical resistance heating element, for heating air. As discussed above, during operation of dryer appliance 10, motor 31 rotates fan 49 of air handler 48 such that air handler 48 draws air through chamber 25 of drum 26. In particular, ambient air enters heating assembly 40 via an entrance 51 due to air handler 48 urging such ambient air into entrance 51. Such ambient air is heated within heating assembly 40 and exits heating assembly 40 as heated air. Air handler 48 draws such heated air through duct 41 to drum 26. The heated air enters drum 26 through an outlet 42 of duct 41 positioned at rear wall 34 of drum 26.

Within chamber 25, the heated air can remove moisture, e.g., from damp articles disposed within chamber 25. This internal air in turn flows from the chamber 25 through an outlet assembly 64 positioned within the interior 62. The outlet assembly 64 includes a vent duct 66 and an exhaust conduit 52. The exhaust conduit 52 is in fluid communication with the vent duct 66. During a dry cycle, internal air flows from the chamber 25 through the vent duct 66 to the exhaust conduit 52, and is exhausted from the exhaust conduit 52. As shown, the internal air can for example flow from the vent duct 66 through an exit conduit 47 defined in the vent duct 66 and air handler 48 to the exhaust conduit 52.

In exemplary embodiments, vent duct 66 can include a filter portion 70 and an exhaust portion 72. The exhaust portion 72 may be positioned downstream of the filter portion 70 (in the direction of flow of the internal air). A screen filter of filter portion 70 (which may be removable) traps lint and other particulates as the internal air flows therethrough. The internal air may then flow through the exhaust portion 72 and to the exhaust conduit 52, such as through the exit conduit 47.

After the clothing articles have been dried, they are removed from the drum 26 via entry 32. A door 33 provides for closing or accessing drum 26 through entry 32.

A cycle selector knob 80 is mounted on a cabinet backsplash 81 and is in communication with a processing device or controller 82. Signals generated in controller 82 operate motor 31 and heating assembly 40 in response to the position of selector knobs 80. Alternatively, a touch screen type interface may be provided. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements such as e.g., electrically erasable, programmable read only memory (EEPROM).

It should be understood that, while FIGS. 1 and 2 illustrate embodiments wherein dryer assembly 10 is a horizontal axis dryer assembly, in other embodiments dryer assembly 10 may be, for example, a vertical axis dryer assembly or another suitable dryer assembly. In a vertical axis dryer assembly 10, for example, cylinder 28 of drum 26 may extend along the vertical axis V between rear wall 34 and front wall 30. Accordingly, the present disclosure is not limited to horizontal axis dryer assemblies. Rather, any suitable dryer assembly is within the scope and spirit of the present disclosure.

Referring now to FIGS. 2 through 7, dryer appliance 10 may further include various components for advantageously facilitating improved drying of articles. Specifically, such components may facilitate reduced or eliminated instances of over-drying and under-drying by measuring and calculating differential humidity values during a dry cycle.

Dryer appliance 10 may thus include a humidity sensor 100 and a valve 102, both of which may be in communication with and thus operable by the controller 82. Humidity sensor 100 may be positioned within the vent duct 66, such as within the exhaust portion 72 of the vent duct 66. Valve 102 may be selectively operable to flow external air (which is generally ambient air from external to the dryer appliance 10) to the vent duct 66, such as to the exhaust portion 72, from external to the cabinet 12. The humidity sensor 100 may operate to sense humidity of air within the vent duct 66. Accordingly, as discussed herein, selective operation of the valve 102 during a dry cycle may cause the humidity sensor 100 to alternately sense internal air humidity values and external air humidity values. These values can be utilized to evaluate a dryness level of articles being dried in chamber 25. Advantageously, the dry cycle operation can be discontinued based on these values, and in particular based on changes in the value differential, resulting in properly dried articles. Instances of over-drying and/or under-drying are thus reduced or eliminated.

Valve 102 in exemplary embodiment is a solenoid valve, although alternatively any suitable valve 102 is within the scope and spirit of the present disclosure. Valve 102 may include an inlet 110 and an outlet 112. External air may be flowed into the valve 102 through the inlet 110 thereof, and from the outlet 112 into the vent duct 66, when the valve 102 is in in an open position. For example, in exemplary embodiments as illustrated, a hose 114 may extend between the valve 102 and the external surface 60 (through one of the panels or cover forming the cabinet), such that an inlet 116 of the hose 114 is in fluid communication with the environment exterior to the appliance 10. The hose 114 may be in fluid communication with the valve 102 such that external air flows through the hose 114 to the valve 102. For example, an outlet 118 of the hose 114 may be connected to the inlet 110 of the valve 102. When valve 102 is in an open position, external air may flow into hose 114 through inlet 116, through the hose 114, from the hose 114 into the valve 102, and through the valve 102. The external air may then exit the valve 102 through outlet 112 into the vent duct 66.

Notably, in exemplary embodiments, the use of a low pressure zone 120 within the vent duct 66, such as within the exhaust portion 72 thereof, may eliminate the need for any blower, motor, fan, or other device to urge external air into an through valve 102 when in the open position. For example, the valve 102 may be at least partially disposed in the vent duct 66, such as within the exhaust portion 72 thereof. In particular, as illustrated, the outlet 112 of the valve 102 may be disposed in the vent duct 66. Accordingly, valve 102 may define a restriction section 122 of the vent duct 66. The restriction section 122 is generally a portion of the vent duct 66 having a reduced cross-sectional area relative to portions both upstream and downstream (in the flow direction of internal air through the vent duct 66) of that portion. Accordingly, the restriction section 122 creates a Venturi effect and resulting low pressure zone 120. The extension of the outlet 112 of the valve 102 into the vent duct 66 may block a portion of the cross-sectional area within a portion of the vent duct 66, thus effectively creating the restriction portion 122 and low pressure zone 120. The resulting Venturi effect and resulting low pressure zone 120 may cause external air to be urged into the vent duct 66 through valve 102 when in the open position and without the need for any other devices to aid such flow. Alternatively, however, a blower, motor, fan, or other device may be utilized to flow the external air into the vent duct 66 as required.

Figure 7:
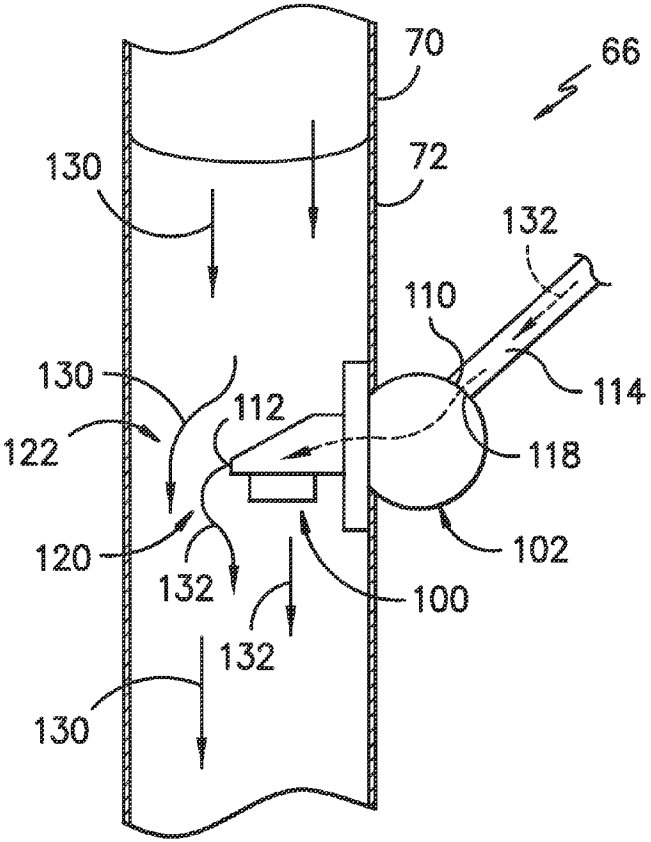
FIG. 7 is a cross-sectional view of a vent duct during operation of a dryer appliance and with a valve open in accordance with one embodiment of the present disclosure.
Figure 6:
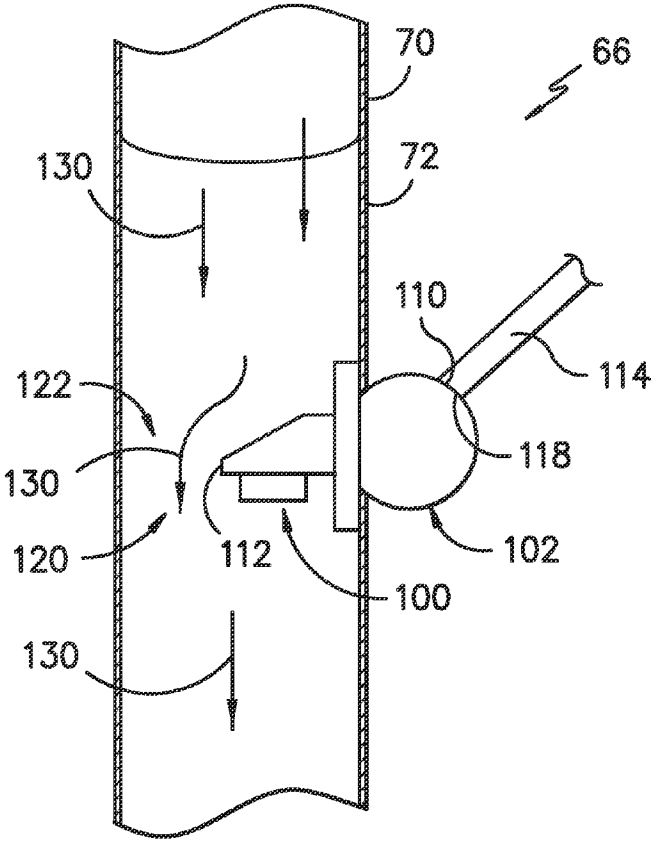
FIG. 6 is a cross-sectional view of a vent duct during operating of a dryer appliance and with a valve closed in accordance with one embodiment of the present disclosure.

Humidity sensor 100 may in exemplary embodiments be located downstream of the valve 102, such as advantageously in the low pressure zone 120. Accordingly, when the valve 102 is open, and external air is flowing into the vent duct 66, the humidity sensor 100 may sense humidity values of this external air. When then valve 102 is closed, and only internal air is thus flowing through the vent duct 66, the humidity sensor 100 may sense humidity values of the internal air. FIG. 6 illustrates an example of the flow 130 of internal air through vent duct 66 during a dry cycle with the valve 102 in a closed position. FIG. 7 illustrates an example of the flow 130 of internal air and the flow 132 of external air through the vent duct 66 during a dry cycle with the valve 102 in an open position.

Figure 8:
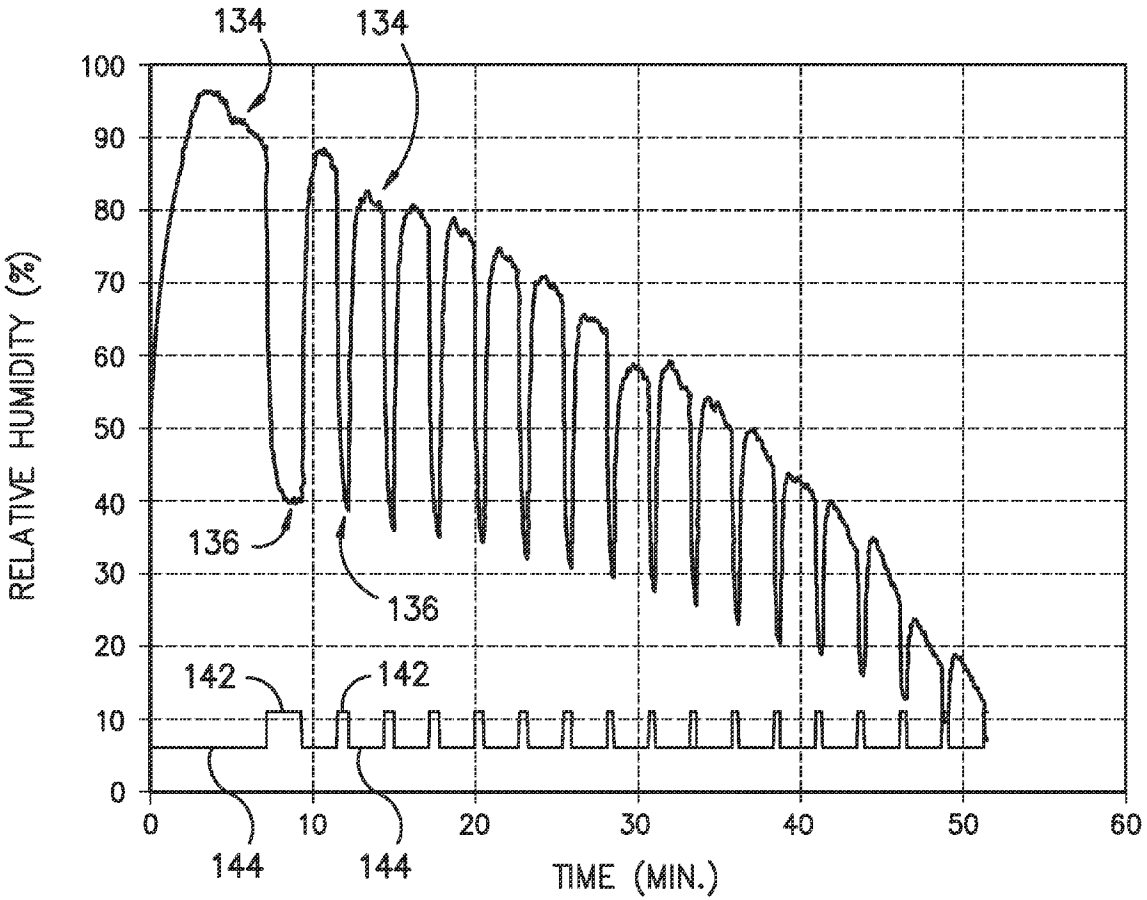
FIG. 8 is a graph of internal air humidity values and external air humidity values measured by a humidity sensor during operation of a dryer appliance in accordance with one embodiment of the present disclosure.

As discussed, selective operation of the valve 102 during a dry cycle may cause the humidity sensor 100 to alternately sense internal air humidity values and external air humidity values. Controller 82, for example, may be in communication with the valve 102 and humidity sensor 100, and may selectively operate the valve 102 to alternate between an open position and a closed position. As discussed, in the open position, external air is flowed through the vent duct 66 and humidity values of the external air are sensed by the humidity sensor 100. Such values may be communicated to the controller 82 by the humidity sensor 100. In the closed position, humidity values of the internal air are sensed by the humidity sensor 100. The valve 102 may be alternated between the open position and closed position such that humidity values of the internal air and external air are alternately sensed by the humidity sensor. FIG. 8, for example, provides a graph of alternating internal air humidity values 134 and external air humidity values 136 taken over a period of time during a dry cycle. Notably, in exemplary embodiments as illustrated, humidity values are measured as relative humidity. The position of the valve 102 is also indicated on the graph as alternating between an open position 142 for a period of time and a closed position 144 for a period of time. Notably, the time periods for the valve in the open position and/or closed position can be fixed time periods and/or variable time periods, as desired. In exemplary embodiments, time periods for the valve to be in the closed position may be fixed, while time periods for the valve to be in the open position may be fixed initially for a first overall time period during the dry cycle and variable for a second overall time period during the dry cycle after the fixed periods. During the variable time periods, the valve may stay open until the humidity sensor registers at or less than the humidity reading of the immediately previous external air measurement. The valve may then stay open for a predetermined period of time after this register, and may then switch to the closed position.

Figure 9:
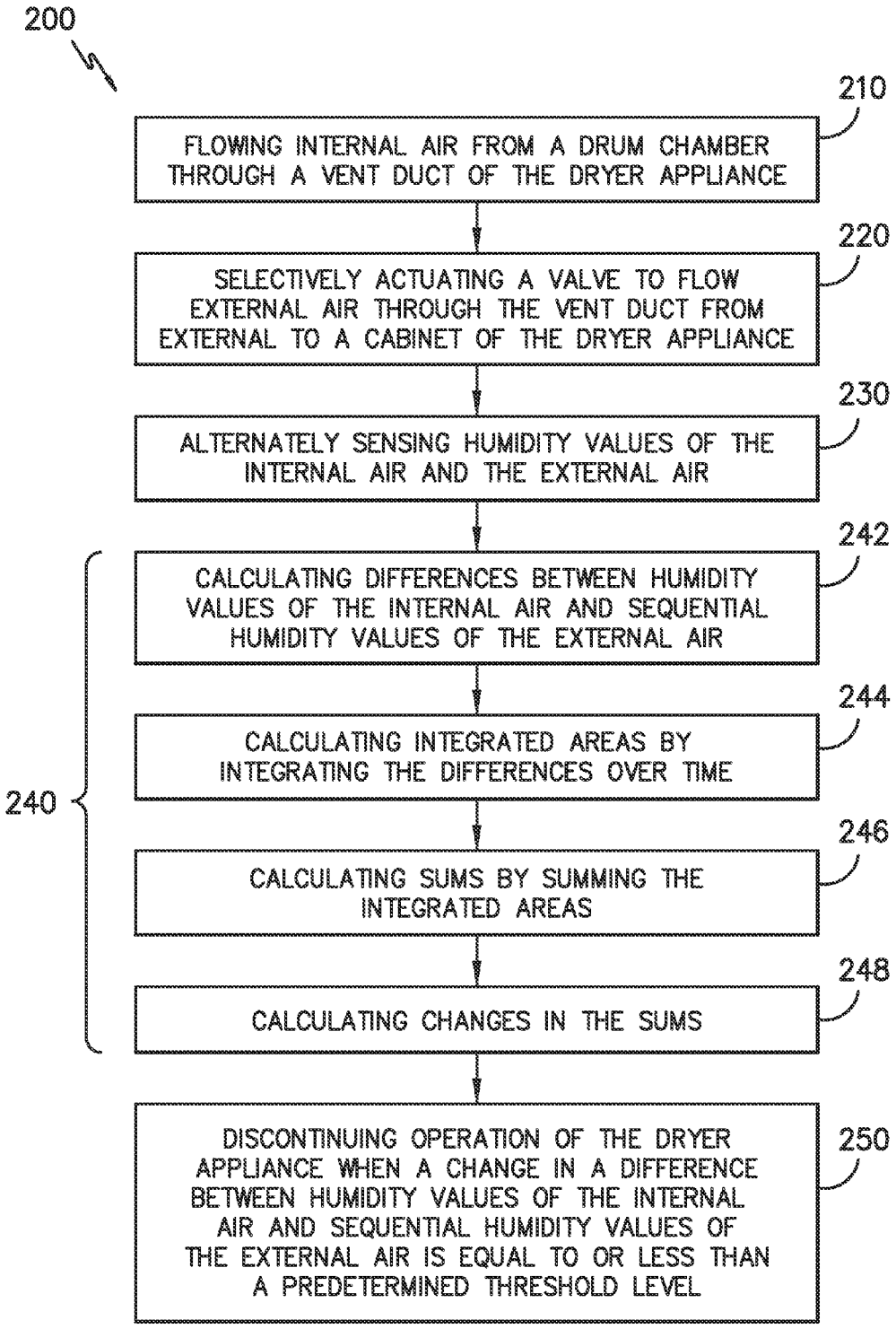
FIG. 9 is a flow chart of various steps of a method for operating a dryer appliance in accordance with one embodiment of the present disclosure.

The external air humidity values 136 and internal air humidity values 134 can be compared and advantageously utilized to determine the dryness of articles being dried in a dry cycle. For example, the present disclosure is further directed to methods 200 for operating dryer appliances. In exemplary embodiments, controller 82 may, for example, be operable to perform the various steps of methods as disclosed herein. Referring to FIG. 9, a method may include, for example, the step 210 of flowing internal air from the chamber 25 through the vent duct 66 of the dryer appliance 10. Such internal air flow is facilitated by, for example, operation of the motor 31 and/or fan 49, such as during a dry cycle. Method 200 may further include, for example, the step 220 of selectively actuating valve 102 to flow external air through the vent duct 66 from external to the cabinet 12, as discussed herein. Method 200 may further include, for example, the step 230 of alternately sensing humidity values of the internal air and the external air, as discussed herein.

In exemplary embodiments, the humidity values of the internal air and external air may be compared to determine a dryness level of articles being dried. Accordingly, method 200 may further include the step 240 of comparing humidity values of the internal air with humidity values of the external air. In an exemplary embodiment, for example, such step 240 may include the step 242 of calculating differences between humidity values of the internal air and sequential humidity values of the external air. For example, a difference may be taken between a group of sensed internal air humidity values 134 and the next sensed group of external air humidity values 136. A group may be defined, for example, by no intervening humidity values of the other type. Notably, in exemplary embodiments, a group of values may first be averaged, and the group average then be utilized to take a difference.

Step 240 may further include, for example, the step 244 of calculating integrated areas by integrating the differences over time. Further, the step 240 may include, for example, the step 246 of calculating sums by summing the integrated areas. Still further, the step 240 may include, for example, the step 248 of calculating changes in the sums.

It should be understood that the various steps as discussed above may occur repeatedly and in real-time during operation of the dryer appliance 10 in a dry cycle. Accordingly, for example, steps 242-248 may be performed repeatedly in real time. For example, in step 246, each new sum may be the sum of all existing integrated areas. In step 248, the slope of a plot of changes in the sums over time may be taken. Notably, in step 248, the changes in the sums may be normalized as required.

In exemplary embodiments, the changes in the sums may be utilized to determine whether articles are considered dry. The changes in the sums as provided by step 248 for example may equate to changes in a difference between humidity values of the internal air and sequential humidity values of the external air. As this change decreases, the internal air humidity values are approaching the external air humidity values. Once this change is equal to or less than a predetermined threshold level, the dryness level of the articles may be considered sufficient (and not over- or under-dried) such that the dry cycle can be discontinued. Accordingly, method 200 may include the step 250 of discontinuing operation of the dryer appliance 10 when a change in a difference between humidity values of the internal air and sequential humidity values of the external air is equal to or less than the predetermined threshold level. Operation may be discontinued by, for example, de-actuating the motor 31, fan 49, valve 102, etc. Advantageously, such operation of the dryer appliance 10 results in efficient and effective drying of articles, and reduces or eliminates instances of over-drying and/or underdrying.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet defining an interior;

a drum positioned within the interior, the drum defining a chamber for receipt of articles for drying;

an outlet assembly positioned within the interior, the outlet assembly comprising a vent duct and an exhaust conduit in fluid communication with the vent duct, wherein internal air flows from the chamber through the vent duct to the exhaust conduit;

a valve selectively operable to flow external air to the vent duct from external to the cabinet; and a humidity sensor positioned within the vent duct, wherein selective operation of the valve causes the humidity sensor to alternately sense internal air humidity values and external air humidity values.

2. The dryer appliance of claim 1, wherein the humidity sensor is downstream of the valve.

3. The dryer appliance of claim 1, wherein the humidity sensor is disposed in a low pressure zone of the vent duct.

4. The dryer appliance of claim 1, wherein the valve is at least partially disposed in the vent duct.

5. The dryer appliance of claim 4, wherein the valve defines a restriction section of the vent duct.

6. The dryer appliance of claim 1, wherein the vent duct comprises a filter portion and an exhaust portion downstream of the filter portion, and wherein the humidity sensor is positioned within the exhaust portion.

7. The dryer appliance of claim 1, further comprising a hose extending between the valve and an external surface of the cabinet, the hose in fluid communication with the valve such that external air flows through the hose to the valve.

8. The dryer appliance of claim 1, wherein the valve is a solenoid valve.

9. The dryer appliance of claim 1, further comprising a controller in communication with the valve and the humidity sensor.

10. The dryer appliance of claim 9, wherein the controller is operable for:

flowing internal air from a drum chamber through a vent duct of the dryer appliance;

selectively actuating a valve to flow external air through the vent duct from external to a cabinet of the dryer appliance; and sensing humidity values of the internal air and the external air.

11. A method for operating a dryer appliance, the method comprising:

flowing internal air from a drum chamber through a vent duct of the dryer appliance;

selectively actuating a valve to flow external air through the vent duct from external to a cabinet of the dryer appliance; and alternately sensing humidity values of the internal air and the external air with a humidity sensor positioned within the vent duct, wherein selective actuation of the valve causes the humidity sensor to alternately sense internal air humidity values and external air humidity values.

12. The method of claim 11, further comprising comparing humidity values of the internal air with humidity values of the external air.

13. The method of claim 12, wherein the comparing step comprises calculating differences between humidity values of the internal air and sequential humidity values of the external air.

14. The method of claim 13, wherein the comparing step further comprises calculating integrated areas by integrating the differences over time.

15. The method of claim 14, wherein the comparing step further comprises calculating sums by summing the integrated areas.

16. The method of claim 15, wherein the comparing step further comprises calculating changes in the sums.

17. The method of claim 11, further comprising discontinuing operation of the dryer appliance when a change in a difference between humidity values of the internal air and sequential humidity values of the external air is equal to or less than a predetermined threshold level.

18. The method of claim 11, wherein the step of alternately sensing humidity values of the internal air and the external air is performed by a humidity sensor, the humidity sensor disposed in a low pressure zone of the vent duct.

19. The method of claim 11, wherein the valve is at least partially disposed in the vent duct.

20. The method of claim 19, wherein the valve defines a restriction section of the vent duct.

* * * * *